US008814644B2

(12) United States Patent
Trouvilliez

(10) Patent No.: US 8,814,644 B2
(45) Date of Patent: Aug. 26, 2014

(54) INTERACTIVE SYSTEM FOR SIMULATING A TREASURE HUNT

(76) Inventor: Bernard Trouvilliez, Viglain (FR)

( * ) Notice: Subject to any disclaimer, the term of this patent is extended or adjusted under 35 U.S.C. 154(b) by 0 days.

(21) Appl. No.: 13/380,117

(22) PCT Filed: Jul. 1, 2010

(86) PCT No.: PCT/FR2010/051386

§ 371 (c)(1),
(2), (4) Date: Jan. 19, 2012

(87) PCT Pub. No.: WO2011/001120

PCT Pub. Date: Jan. 6, 2011

(65) Prior Publication Data

US 2012/0115559 A1 May 10, 2012

(30) Foreign Application Priority Data

Jul. 1, 2009 (FR) ..... 09 03222

(51) Int. Cl.
*A63F 9/24* (2006.01)

(52) U.S. Cl.
USPC ..... 463/9; 273/440; 273/447; 273/454; 273/460

(58) Field of Classification Search
USPC ..... 463/9
See application file for complete search history.

(56) References Cited

U.S. PATENT DOCUMENTS 4,961,575 A * 10/1990 Perry ..... 273/460
5,248,153 A 9/1993 Jones
5,929,848 A * 7/1999 Albukerk et al. ..... 715/700
6,311,982 B1 * 11/2001 Lebensfeld et al. ..... 273/460
6,364,315 B1 * 4/2002 Velke, III ..... 273/454
2002/0198055 A1 * 12/2002 Bull et al. ..... 463/49
2003/0218546 A1 * 11/2003 Lemp, III ..... 340/815.4
2004/0092311 A1 5/2004 Weston et al.
2007/0080831 A1 * 4/2007 Miyamoto et al. ..... 340/995.28
2007/0128975 A1 * 6/2007 Dimitriou et al. ..... 446/397

FOREIGN PATENT DOCUMENTS

EP 1535652 A2 6/2005
FR 2814964 A1 5/2002
WO 95/26790 A1 10/1995

OTHER PUBLICATIONS

International Search Report issued Oct. 1, 2010 by European Patent Office; citing: FR 2 814 964 A1, US 6,311,982 B1, US 2004/092311 A1, WO 95/26790 A1, EP 1 535 652 A2 and US 5,248,153 A.

* cited by examiner

*Primary Examiner* — Tramar Harper
(74) *Attorney, Agent, or Firm* — Cantor Colburn LLP

(57) ABSTRACT

An interactive system for simulating a treasure hunt, comprising a plurality of pseudo-treasures (1) distributed over a playing area (5), and a detector (6) which is allocated to each player (7, 20, 21) and is suitable for scanning over the playing area (5) and detecting at least one pseudo-treasure (1), characterized in that said system further comprises means (24) suitable for allocating, to each player (7, 20, 21), at least one specific pseudo-treasure (1) to be found within a predetermined time period, each pseudo-treasure (1) comprising identification means and each detector (6) being suitable for identifying the scanned pseudo-treasures (1) and indicating the pseudo-treasure or treasures (1) found within the set time period.

10 Claims, 8 Drawing Sheets

INTERACTIVE SYSTEM FOR SIMULATING A TREASURE HUNT

TECHNICAL FIELD

The invention relates to an interactive sound and visual game for simulating a treasure hunt, which can comprise a display of the treasure, simulated digging of holes, and prize distribution.

BRIEF DISCUSSION OF RELATED ART

Many amateurs search for objects, in nature or on beaches, using metal detectors. This practice requires expensive equipment, prior knowledge, and is covered by very strict laws both in terms of archaeology and the found objects; it is prohibited in many places. A larger audience simply wishes to experience the feeling of discovery with the detector while performing a purely recreational activity. The invention makes it possible to resolve this problem by offering a wide audience the possibility, in all locations, both outdoors and indoors, of experiencing the feeling of searching for and finding treasures using a detector in the recreational context of the game or an interactive animation.

BRIEF SUMMARY

The invention makes it possible to meet this need in all or part of its specific characteristics. The invention proposes an interactive system for simulating a treasure hunt. In that spirit, the invention relates to a simulation system made up of pseudo-treasures, detectors (appearance depending on the theme of the game), digging virtual holes, displaying the image of the treasure or distributing prizes, elements making up the various configurations of an interactive sound and visual treasure hunt game.

The principles of the system are as follows:

Pseudo-treasures are distributed over a playing area. These pseudo-treasures, depending on the type of ground in the playing area, may be buried or placed just above the ground invisibly. The pseudo-treasures are detected and identified by the detector allocated to each player. The detectors have various appearances, such as a pseudo-radar, magic wand, wizard's staff, metal detector, etc.

The sensor device of the detector detects the presence of the pseudo-treasures during scanning movements made by the player. Three detection principles and various alternative embodiments are applicable to the system according to the invention.

According to a first detection principle, the pseudo-treasures emit a code specific to them and which is sensed and identified by the detector.

According to a second detection principle, the presence of a passive pseudo-treasure in a small zone of the playing area (to which a virtual code is assigned) is picked up by the detector.

According to a third, reverse detection principle, pseudo-detectors emit a code or frequency specific to them; the pseudo-treasures pick up that code or frequency and transmit them to a game management computer.

The aim of a game is to discover one or more pseudo-treasures within the set time.

The simulation system is particularly characterized in that several players can play at the same time on the same playing area (which may be small) with a limited number of pseudo-treasures. The illusion of random discovery is caused by the fact that each player is unaware of his goals (pseudo-treasures to be discovered), that those goals are different for each player during a game, and that the order of the goals is different for each game. To that end, in the memory of the game management computer, a table of goals is created, specific to each player present in the playing area. This is the list of the numbers of the pseudo-treasures to be discovered during a game and the maximum times allotted to find them. This table is generated by a program according to the invention that automatically determines, in real-time, the timing schedule of the availability of the pseudo-treasures according to the players present in the playing area, their goals, and the evolution of their game. In general, before the beginning of the game, the table of goals has been introduced into the memory of the microcontroller of the detector given to each player; in configurations where the management of the game a centralized, no transfer is necessary.

Players perform their searches by making scanning motions and moving around with the detector.

The microcontroller of the detector triggers the "treasure found" process when the sensor device of the detector has received a treasure number code identical to the goal number (at that stage of the game).

Players are assisted during their pseudo-treasure search interactively by the sound assistance device.

During the "treasure found" process, the microcontroller commands a synthesis circuit, which broadcasts messages to the player via an amplifier in the headset connected to the detector. Through these messages, players will be invited for example to answer quiz questions or dig virtual holes; they may discover the nature of the treasure they have detected or receive various instructions on the progression of the game. Players can answer questions using push buttons. The microcontroller compares the players' responses with the quiz tables loaded into the memory before beginning the game. These tables are made up of sound files associated with valid response numbers and goal numbers.

The operator can configure the simulation system according to four modes in addition to simple pseudo-treasure detection.

- A mode with detection validation by the simulated digging of a virtual hole.
- A mode with detection validation by the simulated digging of a hole and the display of the virtual treasure on a screen.
- A mode for displaying the virtual treasure on the screen as of detection.
- An automatic treasure distribution mode (prize or winnings) after validation of the detection by digging a virtual hole.
- An automatic treasure distribution mode (prize or winnings) as of detection.

These various modes are described below:

> Mode with Validation of the Discovery of Each Treasure by Simulating Digging a Hole.

The player must manually transfer plastic balls that fill a first barrel, into a second barrel identical to the first. When the first barrel is empty, the player submerges his detector in the bottom of the barrel to prove that he has indeed "dug"; the detector senses a code emitted by a proximity transmitter situated at the bottom of the barrel. The player then transfers all of the balls from the second barrel to the first and submerges his detector in the bottom of the second barrel to prove that he has indeed "refilled" the virtual hole; upon reception of the code emitted by the transmitter situated at the bottom of the second barrel, the detector calculates the type of treasure. This calculation is done by associating the treasure number with a table of treasure types that takes the age and sex of the player into account. The detector informs the player of the nature of his win via a sound message.

The two containers can be barrels or can assume various appearances depending on the decorative themes of the game.

> Mode with Detection Validation by the Simulated Digging of a Hole and the Display of the Virtual Treasure on a Screen.

In this mode, the validation of the discovery is identical to that of the previous mode, but the treasure type code is transmitted from the detector to a receiver situated at the bottom of the second barrel, then via a cable or any other means to a game management computer. This computer, owing to software specific to the system according to the invention, establishes the relationship between the treasure type code and a prerecorded image or video clip in the image database pre-existing on the hard disk. This image or clip is automatically broadcast on a large screen. In this way, the player and the audience can see the virtual treasure discovered.

> Mode for displaying the virtual treasure on the screen as of detection. The detector is equipped with a UHF transmitter whereof the first channel retransmits what the player hears in his headset. The second channel retransmits the player's comments as well as the treasure type code in the form of a non-audible encoded signal. This signal is received by a receiver connected to the game management computer, which establishes the relationship between the treasure code and an image or a clip as described above.

> Automatic treasure distribution mode (prize) after validation of the detection by digging a virtual hole. This mode is identical to the mode for displaying the virtual treasure on a screen, with the exception that the software specific to the system according to the invention establishes the relationship between the treasure type code and the number of the chest to be opened prerecorded in the database pre-existing on the hard disk of the game management computer. This relationship being established, the computer controls the electromagnetic locks of the chests or box doors. These chests or boxes contain the prizes, called treasures for the purposes of the game. A chest or box opens automatically as a result of the rules of the game set out by the operator; either a box opens at the end of a winning game, or each time a pseudo-treasure is found.

> Automatic treasure distribution mode (prize or winnings) as of detection. This mode is identical to the mode for displaying the virtual treasure on the screen as of detection thereof, with the exception that the game management computer triggers the opening of the chests and boxes under the same conditions as described in the previous paragraph.

>>>> According to particular embodiments specific to the first detection principle, with sound assistance, in the detection validation mode by simulating the digging of a hole and displaying the virtual treasure on a screen, the system according to the invention comprises:

>> Pseudo-treasures that assume the form of sealed cases. These treasure simulators are provided with a microcontroller producing an encoded logic signal of several bits representative of the treasure number. This signal modulates, in FSK (frequency-shift keying), the low-frequency sinusoidal current injected into the circuit tuned to a narrow band made up of the transmission coil of the electromagnetic field and a capacitance. Specifically, the frequency shifts occur with a very small frequency interval so as to be compatible with the narrow bandwidth of the tuned circuit.

In the case of outdoor use, a current with a large wavelength is used so that the emitted field propagates with a low loss in a very moist medium (for example, wet sand). These treasure simulators are randomly distributed under a developed playing area, for example buried under a sand or soil surface. When the ground is hard, or indoors, the pseudo-treasures are miniaturized and integrated into a carpet imitating a lawn or a parquet floor placed on the ground. The playing area, given the magnetic coupling system used, can have a modest size, there being no interference to fear between the treasure simulators beyond their unique transmission zone, which is limited to 60 centimeters. This specificity allows indoor use.

If the battery powering the pseudo-treasure is nearly empty, an appropriate assembly detects it and a specific code is emitted. In case of fixed or indoor installation, the battery as well as the brown-out circuit are advantageously replaced by a low-voltage power cable shared by all of the pseudo-treasures.

>> Detectors Whereof One is Allocated to Each Player.

As of start-up, the microcontroller of the detector controls a sound synthesis circuit; the player is guided by his detector, which broadcasts, in the headset connected thereto, the rules of the game. The detector picks up the encoded magnetic field of the treasure simulators owing to its high-quality circuit tuned on the same frequency as that of the pseudo-treasures, which excludes any parasitic or unwanted field.

During the scanning movements performed by the player, the microcontroller of the detector continuously analyzes those signals. Once the coil of the sensing device of the detector receives a treasure number code identical to the goal (at the stage of the evolution in the table stored in memory), the microcontroller triggers the "treasure found" process. This process can comprise a sound and light animation varying according to the electromagnetic field, therefore as a function of the proximity of the pseudo-treasure. This animation can include devices such as: a lighted strip, a pseudo-radar screen visible by the player, a speaker.

The sound assistance broadcasts a message to the player inviting him to dig a virtual hole as already described.

>> Two Barrels Situated on the Edge of the Playing Area.

At the center of the bottom of each barrel, at the end of an inverted cone intended to bring the balls together, is a device identical to a pseudo-treasure but with a very weak transmission power (proximity transmitter). The sensing device of the detector having the same diameter as the end of the cone, only removing the last ball makes it possible to put the detector in contact with the proximity transmitter. When, following the maneuvers already described, the microcontroller has calculated the type of treasure, this code is retransmitted by an infrared diode included in the sensing device of the detector toward an infrared phototransistor situated at the bottom of the second barrel. Next, a cable communicates it to the game management computer, which will display the image of the treasure using the described means.

The game is won when the player has found and potentially validated all of the treasures set out by the rules of the game. During the game, the detector records each player's successes and failures (treasures found or not found) in memory and limits the duration of each discovery and the total duration of the game.

According to other, lower performing embodiments adapted to cases of non-buried pseudo-treasures, the pseudo-treasures and the sensing device of the detector are capacitive, or ultrasound, or infrared, or high frequency transmitters and receivers.

One particularly economical alternative adapted to a small playing area comprises a matrix of infrared LED diodes incorporated into a carpet, the upper surface of the carpet being transparent to the infrareds and opaque in the visible spectrum. This matrix is connected to the ports of a microcontroller that is connected with the game management computer. By program, the bearing lines power, with a pulsed signal, several LED diodes serving as pseudo-treasure during a game. The sensing devices of the detectors are infrared phototransistors. This alternative is the opposite of the third detection principle described later.

>>>> According to particular embodiments specific to the second so-called "zone preselection" detection principle. The system according to the invention comprises:

A microcontroller that receives, from a GPS circuit or a position detector circuit, the spatial coordinates of the detector at all times. The goal table introduced into the memory of the microcontroller is made up of perimeter coordinates of each of the small zones in which the pseudo-treasures to be located are situated and the maximum times allotted to perform the detection. The pseudo-treasures are passive; they do not emit a code, but can be located owing to the detector given to each player. The microcontroller triggers the "treasure found" process when the detector is situated over a position that is within the perimeter of the zone set as goal and the sensing device has detected the pseudo-treasure by field absorption. According to this second principle, the pseudo-treasures being passive, the detector emits a magnetic field that will be particularly absorbed by the pseudo-treasure. The pseudo-treasures are tuned circuits (capacity inductance), or any other absorbing device, for example a Thomson ring.

In the specific case of a centimetric precision position detector (made up for example of two SHF telemeters), the passive pseudo-treasure can be removed in favor of 5 concentric mini-zones of 10 to 60 cm for each treasure. Each zone corresponds to a virtual signal level that increases from the outermost zone to the central zone.

The table loaded in the memory of the detector comprises the coordinates of the outer zone; the other zones (still of the same size) are determined by calculation by the microprocessor of the detector. The pseudo-treasure becoming completely virtual, it is possible to create, in each game, changes in the position of the treasure over the playing area. The two antennas of the telemeters can advantageously be positioned parallel to a length of the perimeter of the playing area in the extension of the two diagonals at a distance of several meters from the area.

>>>> According to particular embodiments specific to the third so-called "reverse" detection principle, the system according to the invention comprises:

Pseudo-detectors that each continuously emit a frequency that is specific to them. A matrix of sensors integrated into the playing area (cabled in XY) transmits the signal to a detection interface. This interface selects the sensors serving as pseudo-treasures and transforms the frequency into code. This code is communicated to a game management computer that compares the sensed code with the table of goals for the player. This detection principle is adapted to economical indoor games. As a result, the sensors can be coils sensitive to a low-frequency or high-frequency electromagnetic field coming from the coil of the pseudo-detector or metal surfaces that are coupled capacitively with the transmission plate of the pseudo-detector, but also a matrix of photo-detectors incorporated into a plastic carpet whereof the upper surface is transparent to infrareds.

This principle is adapted to the automatic distribution mode of the treasure upon detection; the connection with the computer being constant and economical. In return, the player does not have any sound assistance and the interactivity is limited.

Devices incorporated into the system as a function of the selected exploitation modes:

>> A Game Management Computer

When a player comes to the counter, the operator enters data using the keyboard: the difficulty level (to adapt the quizzes as a function of the player's age), the number and types of treasures to be found, the language and duration of the game. The table of goals is different for each player. The management of the goal tables and maximum times given can be centralized using a computer owing to the time planning software; this device allows a fluid organization of the games. The system according to the invention can, however, operate minimalistically, without a computer, with goals frozen in the memory of the detectors, but in that case the number of players who can play at the same time on the playing area will be reduced.

Each detector has a serial connecting plug that makes it possible, when the detector is given to the player at the beginning of the game, to test the general operation of the detector and the level of its battery, then to transfer the goal and quiz tables from the computer to the memory of the detector.

At the end of the game upon return of the detector, the connector makes it possible to transmit detailed results of the game from the detector to the computer. The operator can display whether the game was won or lost on the screen, the nature of the treasures, the performance for each goal, and can store the score on a hard disk with the aim of running competitions.

The computer receives the treasure code via the cable connected to the sensor of the second barrel, by a UHF receiver producing a link with the detector or via the serial connection at the end of the game.

Software, specific to the system according to the invention, establishes the relationship between the treasure type code and an image or video clip prerecorded in the image database preexisting in the hard disk. This image or clip is automatically broadcast on the large screen. In this way, the player and the audience can immediately see the virtual treasure.

If the operator wishes to distribute prizes, the management computer controls, relative to the treasure type code, through its parallel port and via power transistors, the electromagnetic locks (or opening cylinders) of chests or box doors. These chests or boxes contain prizes called treasures for the purposes of the game. A chest or a box opens automatically according to the rules of the game set by the operator. He can choose to open a box at the end of a winning game or each time a pseudo-treasure is found.

<<A Display Device

This device connected to the video card of the game management computer is made up of flat television screens or indoors of a video projector.

According to the configurations chosen by the operator, the system according to the invention can comprise appended animation devices:

The detector can be equipped with a UHF retransmission transmitter characterized in that a first transmitting channel connected to the synthesis retransmits what the player hears in his headphones.

The second transmitting channel retransmits the player's comments picked up by the micro-headset. These two channels received by a UHF receiver, then mixed with the comments made in the microphone by the organizer of the game, can be broadcast by a PA system, a radio or during a television transmission. This animation increases the audience's interest in the game.

The system according to the invention can comprise devices compatible with the configuration and display and distribution modes as of detection:

The treasure type code is transmitted in the form of an encoded signal via one of the channels of a UHF retransmitter.

This signal is received by a UHF receiver (not shown) connected to the game management computer.

The encoded signal is, according to one embodiment, a non-audible encoded signal at 30 Hz emitted by the synthesis. This frequency is blocked by a high-pass filter at the audio mixing so as not to be broadcast in the PA system.

BRIEF DESCRIPTION OF THE DRAWINGS

The invention will be better understood and the advantages thereof will appear more clearly in light of the descriptions of embodiments of the devices according to its principles and the preceding definition, which will follow, provided solely as an example, and done in reference to the appended drawings, in which.

DETAILED DESCRIPTION

Figure 1:
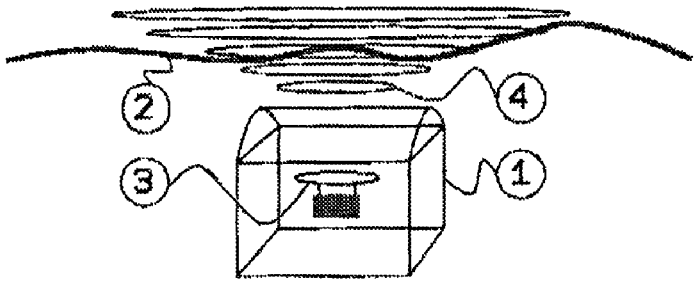
FIG. 1 is an illustration of a pseudo-treasure according to the first detection principle of the system according to the invention.

>> Embodiment According to the First Detection Principle with Sound Assistance, Validation by Simulation of Digging a Virtual Hole and Display of the Treasure FIG. 1 shows a chest (1) containing an electronic circuit, battery powered, connected to a coil (3). The chest is buried under the ground (2). The electronic circuit connected to the coil (3) generates an alternating current therein, which results in creating a magnetic field (4) that develops above the surface of the ground (2). This magnetic field is modulated and encoded by the electronic circuit connected to the coil (3). The treasure simulator, although invisible, can be referenced and identified owing to the use of a special detector according to the invention.

Figure 2:
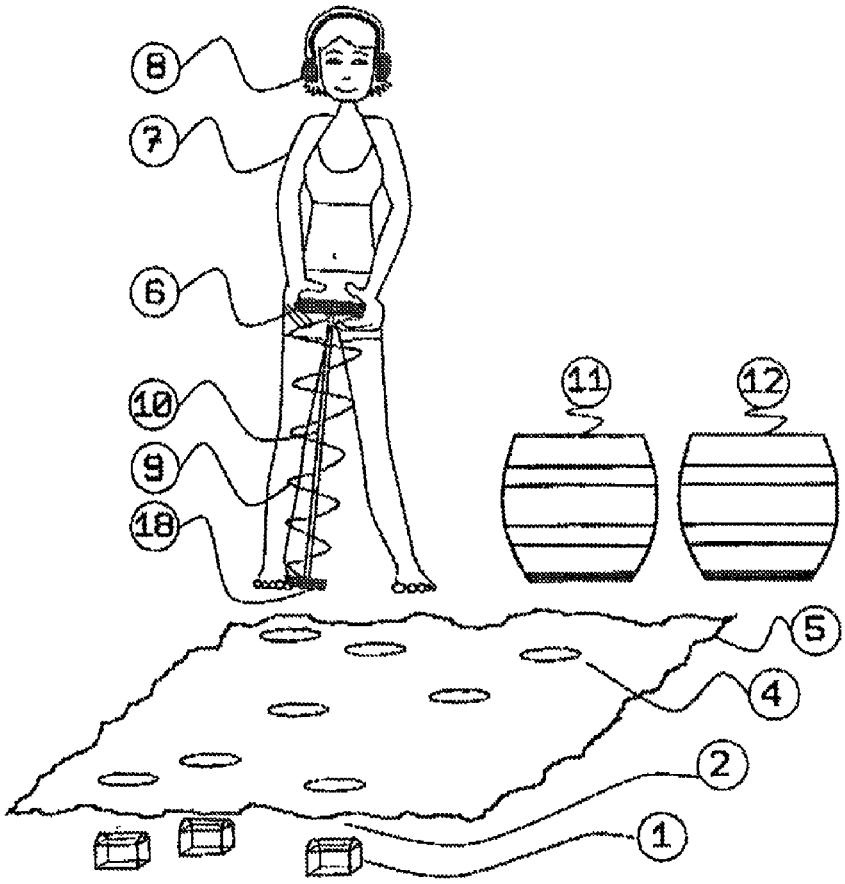
FIG. 2 shows the usage configuration of the pseudo-treasures, a detector and the barrels or casks, which are devices that are part of the system according to the invention.

In reference to FIG. 2, the chests of the pseudo-treasures (1) are positioned under the ground (2) distributed over a surface called playing area (5). Each pseudo-treasure produces a field (4) on a reduced surface of the playing area.

This field is sensed by a detector (6) according to the invention. The player (7), through a scanning motion and movement of the coil of the detector (18), looks for a treasure hidden under the playing area (5).

The detector (6) emits a sound signal in the headset (8) and light animations of the spiral (9) that surrounds the support tube (10) when it is in the presence of the magnetic field of the pseudo-treasure whereof the code corresponds to the treasure that the player must find. The detector broadcasts a sound message to announce to the player that he has detected a treasure, then invites the player to move toward the barrels (11 and 12) to dig a virtual hole.

Figure 3:
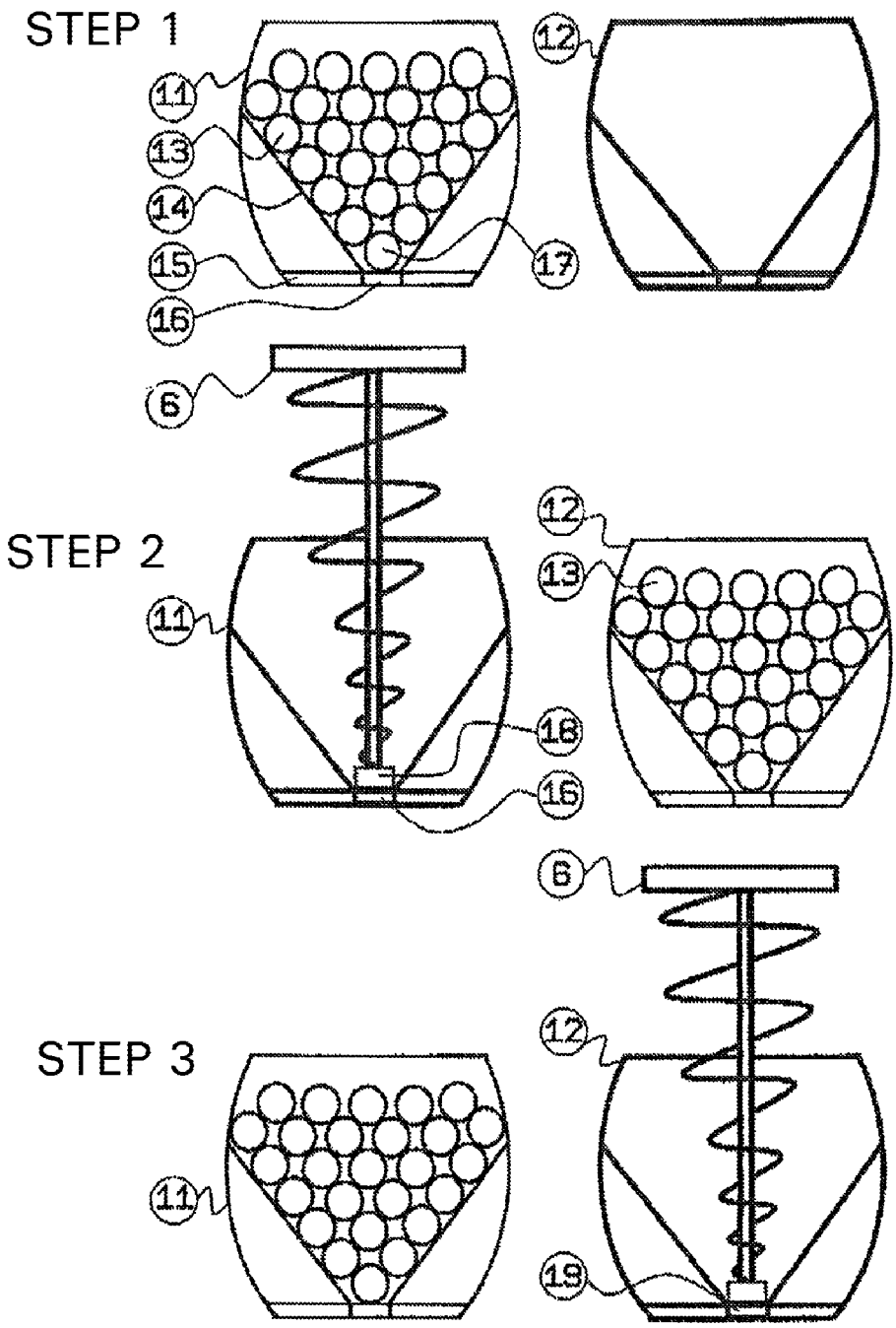
FIG. 3 shows sketches of three steps of the operating principle of the simulation of digging a hole.

In reference to FIG. 3, which shows the simulation of digging in three stages, in the first stage one can see the presence of two barrels shown in cross-section. The first barrel (11) contains balls (13) that rest on a conical surface (14) fixed on the bottom (15) and the side of the barrel. The bottom is equipped with a magnetic transmitter (16) identical to the transmitters of the pseudo-treasures, but with a very low power. The second barrel (12) is similar to the first but, initially, does not contain balls. The player, to simulate the digging of a hole, must manually transfer all of the balls, including the last one (17), into the second barrel. In the second stage, the barrel (11) being completely empty, the player can submerge his detector (6) in the barrel and put the coil of the detector (18) in contact with the transmitter of the bottom (16). The virtual hole having been dug, the detector triggers a sound message that invites the player to plug them back up by removing his detector (6) from the first barrel (11), then transferring all of the balls (13) from the second barrel (12) to the first barrel. In the third stage, all of the balls have been returned into the first barrel (11), which allows the player to submerge his detector (6) in the second barrel (12) until it comes into contact with the transmitter of the second barrel (19). The detector informs the player, by a sound message, about the nature of the virtual treasure he has just discovered. The detector transmits a code to the game management computer (24—FIG. 4) via the infrared diode (98—FIG. 6) incorporated into the center of the coil (18). An infrared phototransistor integrated into the transmitter of the second barrel (19) is connected to an input of the management computer which, using appropriate software, is able to display an image of the treasure on the video projector screen (25—FIG. 4).

At this stage, the detector broadcasts a quiz in the headset to which the player will respond by pressing on push buttons. A correct response allows the player to find another treasure on the playing area more quickly.

Figure 4:
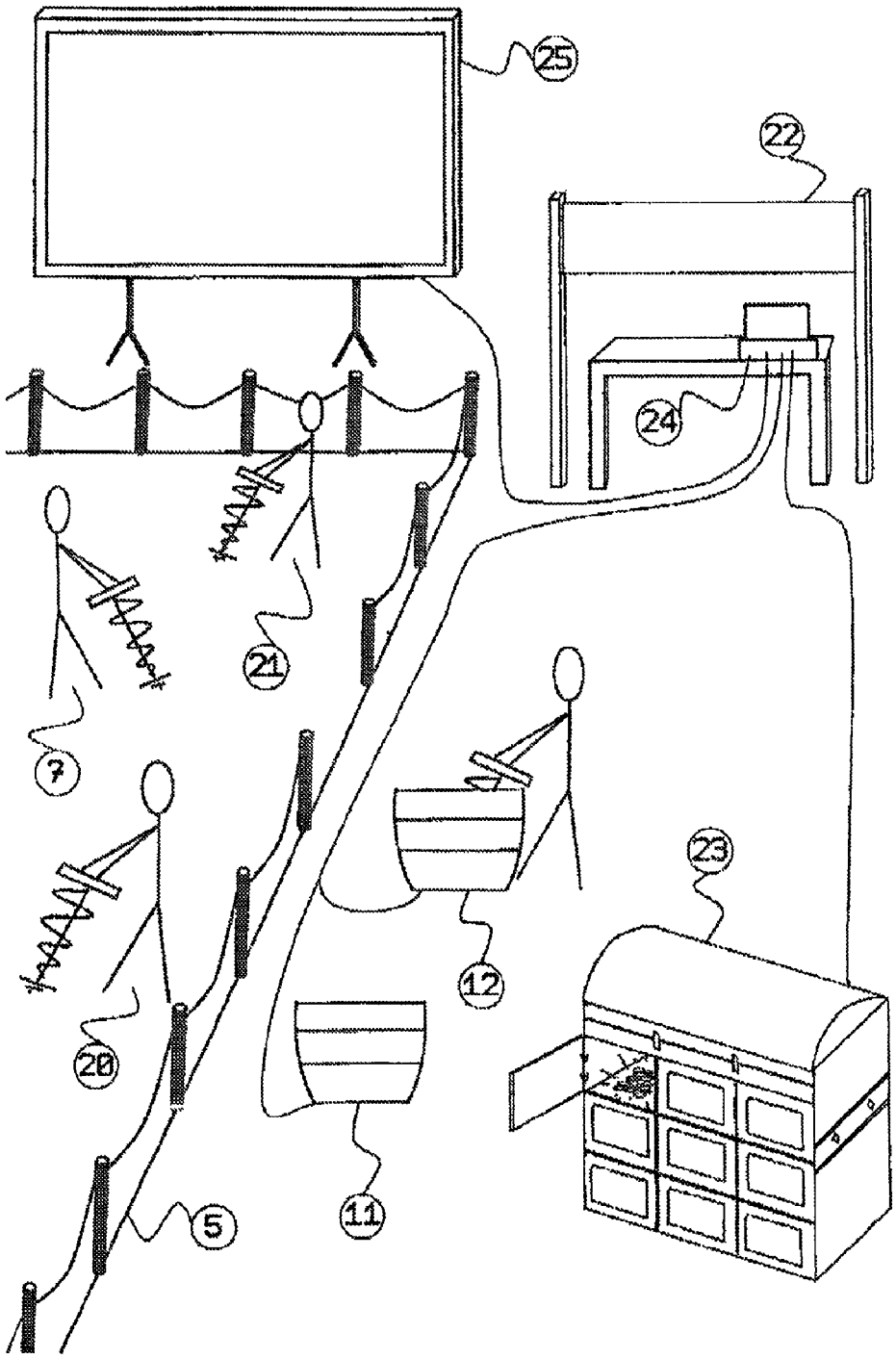
FIG. 4 shows a general organization of the game, which combines the validation modes with digging of a hole and automatic treasure distribution.

FIG. 4 shows the general organization of the game. Players (7, 20, 21) are present on the playing area (5). A welcome counter (22) receives the game management computer (24). This computer is connected to a video screen (25) or a large format TV monitor, the second barrel (12) or, in prize distribution mode, a box (23). These connections can be wired or a HF connection.

At the beginning of the game, the organizer, using the game management computer, introduces the player's goal table into the memory of the detector via a serial connection; as a result, the player must find his pseudo-treasures in several steps in the playing area (5) and makes, in each step, his pseudo-holes with the barrels (11 and 12) in a predetermined time to win the game or a prize (examples of game rules).

The game management computer includes, in its hard disk, multiple game levels and themes; the operator can therefore adapt the detector to the player's age and the themes of the game.

Outside the playing area (5) can be a semi-hard ground surface such as dirt, lawn or a loose type such as sand or gravel; in these cases, the pseudo-treasures are buried.

Inside or when the ground is hard, the playing area can be a carpet or a parquet floor incorporating the transmitters in miniature form.

Figure 5:
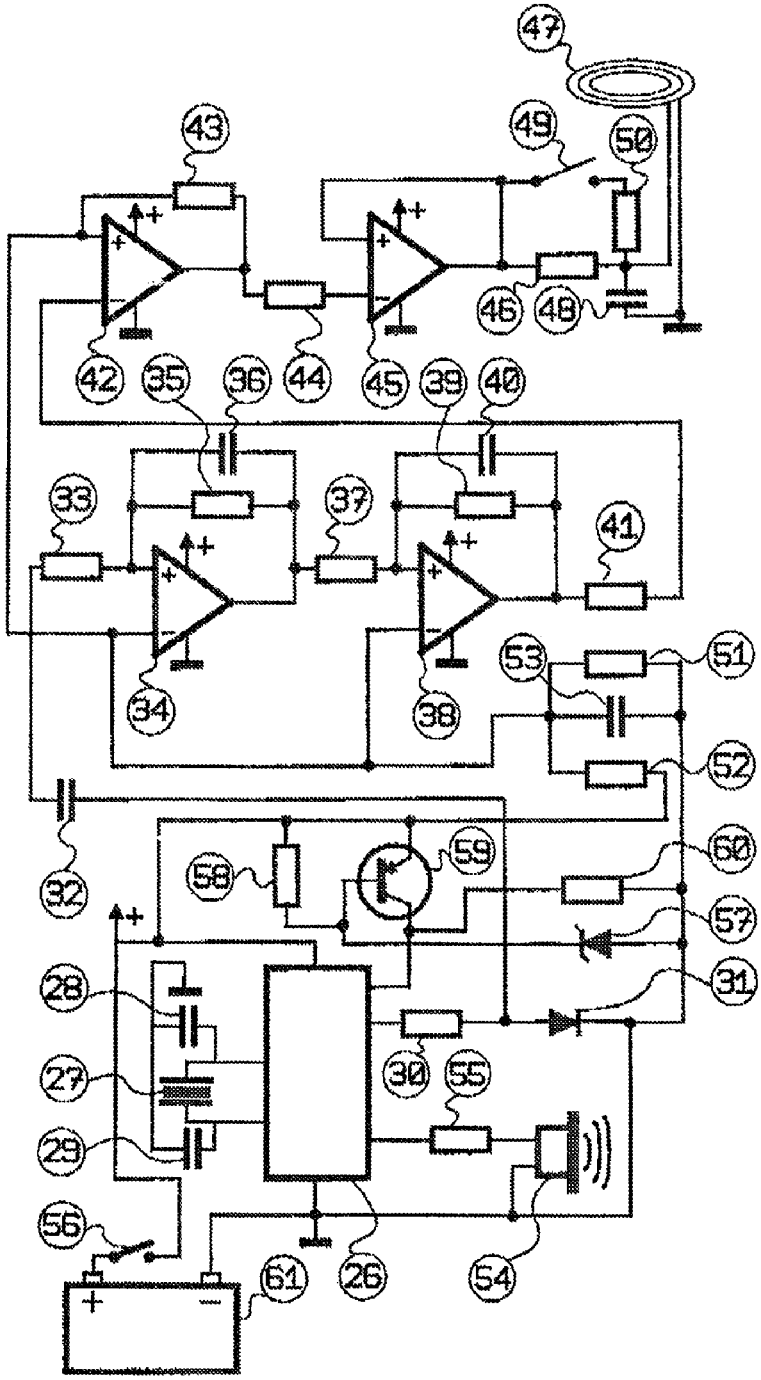
FIG. 5 shows a block diagram of the electronic circuit of the pseudo-treasure according to the first detection principle.

FIG. 5 shows that the oscillator of the microcontroller clock (26) of the pseudo-treasure is controlled by a quartz (27) and two capacitances (28 and 29) to ensure good stability. The microcontroller (26) generates a square signal modulated by a shift of two low frequencies. These shifts of two very close frequencies (for example 24 and 26 kHz) correspond to a code according to the so-called FSK mode. This signal is transmitted via the Resistance (30) but limited to 0.7 V by the diode (31). The capacitance (32) and the resistance (33) present the signal to the input of an integrating circuit made up of the operational amplifier (34) of the resistance (35) and the capacitance (36). This integrating circuit is calculated so as to convert the square signal into a triangular signal that is presented via the resistance (37) to the input of a filter formed by the amplifier (38), the resistance (39) and the capacitance (40). At the output of this filter the signal is sinusoidal, the resistance (41) transmits it to the amplifier (42) whereof the gain fixed by the resistance (43) allows the signal to rise to 3 V. The resistance (44) leads the signal toward the unitary gain amplifier (45), the output of which via the resistance (46) injects, into the tuned circuit made up of the transmission coil (47) and the capacitance (48), the frequency-modulated encoded signal. In the case where the ground has a low magnetic impedance, the transmission power can be increased by the placement in parallel owing to the switch (49) of the resistance (50) with the resistance (46).

A divider bridge made up of resistances (51 and 52) has a voltage filtered by the capacitance (53) at each of the inputs+ the four amplifiers.

The treasure simulator comprises a Butzer (54) connected on an outlet of the microcontroller via a resistance (55) which informs the operator by a beep during powering on by the switch (56) of the powering on.

A brown-out detection circuit, made up of a fixed voltage source, formed by the zoner (57) and the resistance (58) and a threshold detection done with the transistor (59) and the resistance (60) aims, once the reserve level of the battery (61) is reached, to change the level of an input of the microcontroller. The latter causes a series of beeps in the Butzer (this function makes it possible to find the treasure simulator easily when it is buried) and the transmission of a specific code called low battery to the detector. Through this principle, the operator is informed at the end of each game of the level of the batteries of the pseudo-treasures that have been detected by the player.

When the pseudo-treasures are permanently buried (fixed playing area) or included in a carpet or a parquet floor, the batteries are replaced by a low-voltage power cable shared by all of the pseudo-treasures.

Figure 6:
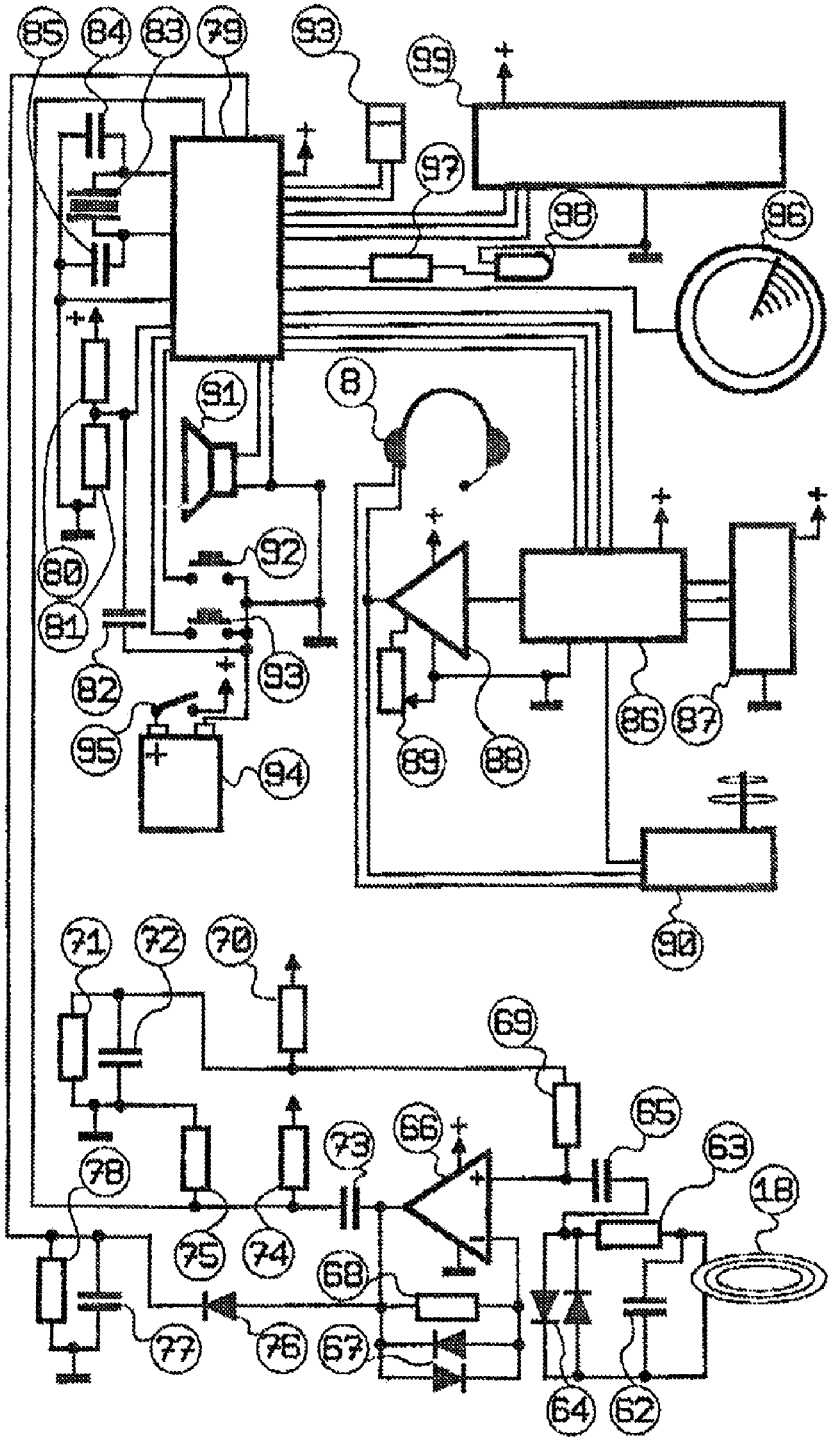
FIG. 6 shows a block diagram of the electronic circuit of the detector according to the first detection principle.

FIG. 6 shows the presence of a detecting coil (18) situated at the end of the detector. This coil is designed to receive, by mutual induction, the magnetic field created by the coil of the pseudo-treasures. It also forms, with the capacitor (62), a band-pass filter that eliminates the frequencies other than the emission frequencies of the pseudo-treasures. The resistance (63) and the two head-to-tail diodes (64) constitute a safety by limiting the voltage against electrical shocks. The signal is presented via the capacitance (65) to a first non-linear specific amplifier stage (66). The signal at the capacitance (65) varies in very significant proportions as a function of the scanning motion made by the player, in fact the coupling factor varies as a function of the cube of the detection distance. The amplifier stage must have a high input impedance and a gain inversely proportional to the signal present at the input without reaction delay. The solution to this specific need is provided by the presence of the head-to-tail diodes (67) mounted in parallel with the reaction resistance (68). The polarization at half of the power voltage of the input+the amplifier (66) is ensured, via the resistance (69) by the resistance divider bridge (70 and 71). The capacitance (72) ensures the filtering and virtual reunion of the alternating ground.

When the current caused in the coil (18) is weak (detection distance up to 80 cm for a transmission power lower than 1 mW), the diodes do not conduct, the gain of the amplifier (66) is very significant. When the player presents the coil at the vertical of a pseudo-treasure, the field and the current caused are maximum, the diodes (67 and 68) conduct and therefore the amplifier has a low gain.

The signal is transmitted by the connecting capacitance (73) to a polarization bridge made up of resistances (74 and 75) then to the minus input of the internal comparing element of the microcontroller (79). The plus input of the comparing element is connected to the divider bridge formed by the resistances (80 and 81), the capacitor (82) ensures the filtering. This mounting compares the evolution of the signal with a level corresponding to the virtual mass, which creates a level change of the output of the comparing element internal to each sinusoid. The FM demodulation of the code emitted is ensured by this circuit and suitable software. The stabilization of the clock of the microcontroller (79) is ensured by the quartz (83) and the capacitances (84 and 85). The microcontroller (79) is connected to a sound synthesis circuit (86) comprising a removable memory (87). The sound synthesis output is connected to an audio amplifier (88) whereof the gain can be adjusted owing to a potentiometer (89), this amplifier is connected to a headset (90). A speaker (91) makes it possible to broadcast sounds synthesized by the microcontroller (79). Push buttons (92 and 93) through which the player can respond to the quizzes are connected to the microcontroller (79). The powering on of the detector is done by a switch (95); the power supply is ensured by a battery (94).

In the case where the player has placed the coil of his detector near one of the pseudo-treasures; if the code is the same as the stored goal, the microcontroller transmits an instruction to the sound synthesis (86) that broadcasts a sound signal evoking a radar echo whereof the frequency varies as a function of the received magnetic field level. This sound signal is broadcast in the headset (8) or in the speaker (directly from the microcontroller). On the other hand during the approach, a radar screen visual simulator (96) made up of LED diodes has emitted concentric slivers as a function of the level of the received magnetic field. The level increase also causes an increase in the frequency of the flashes emitted by the light spiral (9—FIG. 2). The level is detected by the diode (76), which rectifies the signal coming from the amplifier (66), the capacitance (77) and the resistance (78) form a time constant that determines the reaction speed of the detector to the variations of the field.

This variable continuous signal is then presented at the input of the analog-digital converter inside the microcontroller by software: this data frequency modulates the sound and light animations previously described.

The detector then broadcasts a message to a player inviting him to dig a virtual hole under the conditions described by the associated text in FIG. 3, the player places his detector at the bottom of the first barrel. The detector receives the code of the first barrel emitted by the transmitter (16), after concordance verification the microcontroller (79) triggers the synthesis (86), which broadcasts a message inviting the player to return the balls to their initial place; when the player introduces his detector into the bottom of the second barrel, the microcontroller (79) senses the code of the second barrel and emits a digital signal encoded by frequency modulation in the resistance (97) connected to the infrared diode (98). This signal will be picked up by the phototransistor situated at the bottom of the second barrel, then transmitted to the management computer.

The first goal being found, the microcontroller (79) stores this result and transmits instructions to the synthesis (86) or the display (99) so as to broadcast a quiz. The player answers it by actuating the yes button (91) or the no button (92). If the response correct, the microcontroller broadcasts a clue allowing the player to find his next goal.

Lastly, the microcontroller (79) signals the end of the game to the player, which can be due to exceeding the allowed time or successfully finding all of the goals of the game.

The principle of the system according to the invention and all of the devices making up that system allows several players (20, 21, 8—FIG. 2) to play on the same playing area (5—FIG. 2) with a limited number of pseudo-treasures (1 FIG. 2) which remain in place from game to game; the program of the steps of the game and the quizzes have been introduced into memory by the serial connection (93) at the beginning of the game.

Figure 10:
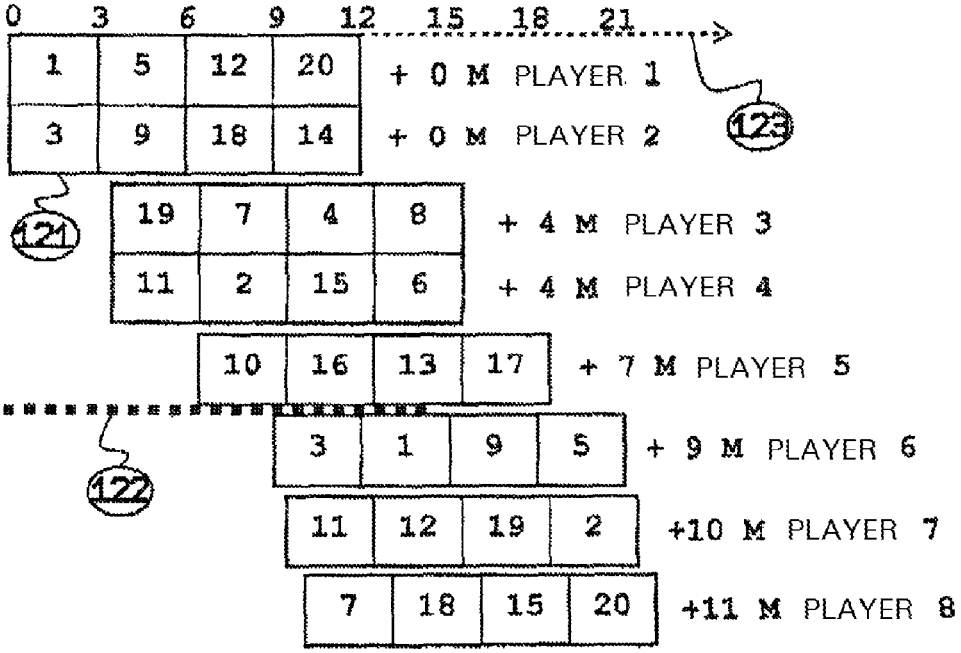
FIG. 10 shows goal tables and their automatic management mode.

FIG. 10 shows a time schedule managed by the software, according to one of the principles of the invention, installed in the management computer, a configuration is observed described as an example comprising 20 pseudo-treasures. One can see four-column tables (121), each line represents the four goals of each player, the columns represent the maximum times (3 minutes) for each goal. The origin of the tables is shifted to the right as a function of the arrival of the players from the origin of the axis of the times (123). The twenty treasure numbers (recorded in the boxes) are randomly distributed for the first 5 players. In the stage shown by a broken line (122), apparently no more available pseudo-treasures remain, no player having returned his detector. The game management software calculates the pseudo-treasures which, although part of the goals of players present in the playing area, are already available since the maximum times to discover them have elapsed. As a result, pseudo-treasure no. 3 can be allocated to player no. 6 while player no. 1 is present on the playing area.

The tables of goals for players nos. 6, 7 and 8 are randomly formed with the available pseudo-treasures and the treasure numbers that soon will be in minute 11, player no. 8 is assigned treasure no. 7, which is effectively available, but also no. 20 that player no. 1 is looking for at that time. This possibility exists since player no. 8 will look for that treasure 9 minutes later; player no. 1 at that stage will have finished his game. This optimization device is intended to absorb the peak flows of players. During normal operation, the game must have a much larger number of pseudo-treasures than the number of players present on the playing area so as to preserve the random nature of the games.

In case of extended saturation, the software would propose to the operator to organize games including three goals, or 9 minutes.

>> Embodiment According to the Second Detection Principle

Called zone preselection, usable outside buildings and over a large playing area.

Figure 7:
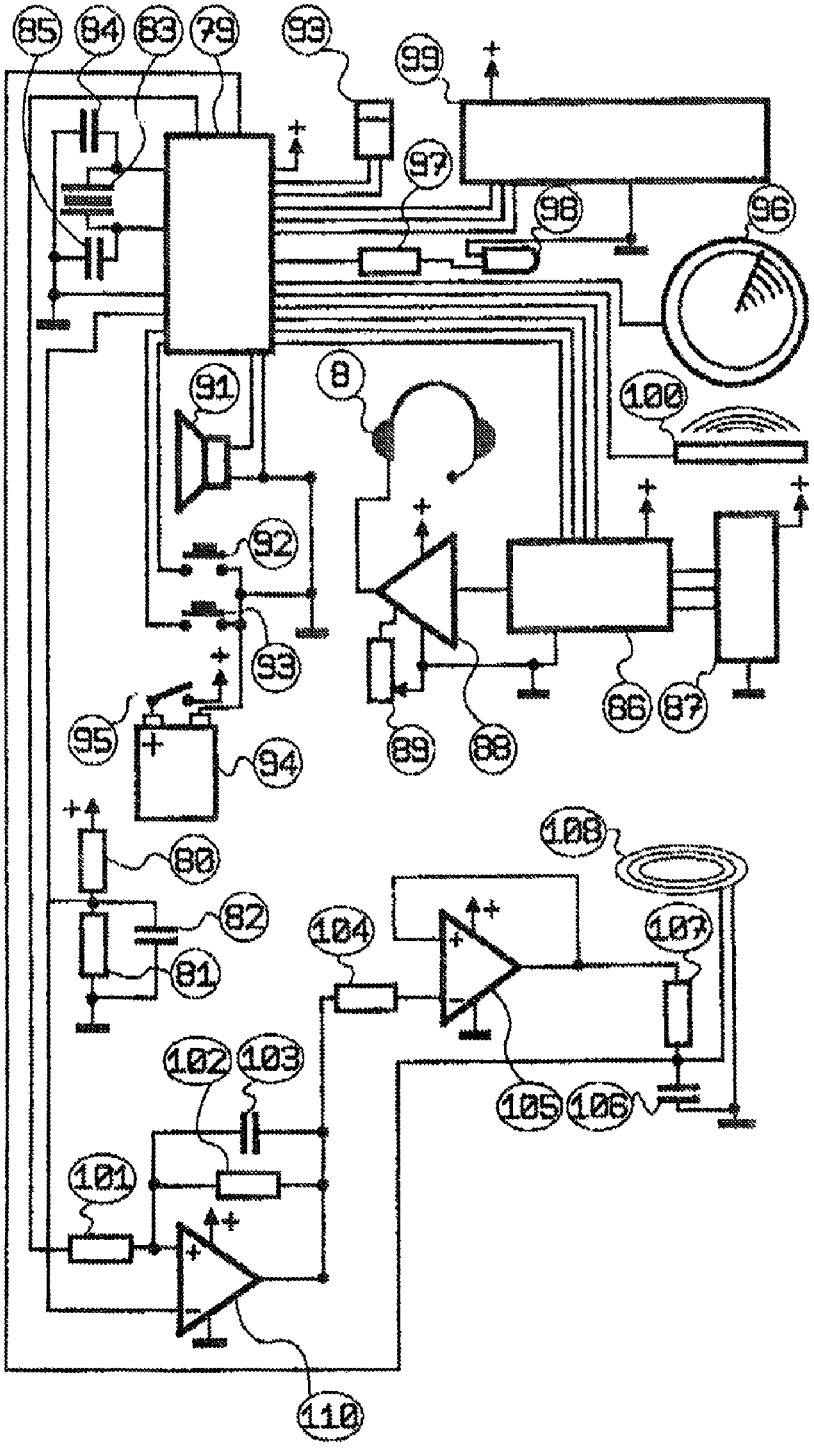
FIG. 7 shows a block diagram of the electronic circuit of the detector according to the second detection principle.

In reference to FIG. 7, the microcontroller receives, from a GPS circuit (100) or a position detection circuit, the spatial coordinates of the detector at any time. The goal table introduced into the memory of the microcontroller (79) is made up of perimeter coordinates of each of the small zones in which the pseudo-treasures to be found are situated and the maximum times granted to perform the detection. The pseudo-treasures are passive; they do not emit a code, but can be located owing to the detector given to each player. The microcontroller triggers the treasure found process when the detector is situated on a position that is within the perimeter of the fixed goal zone and the sensing device has detected the pseudo-treasure by field absorption. According to this detection principle, the digital analog converter of the microcontroller (97) produces a summary low-frequency sinusoidal current. This current passes through the active filter made up of the resistances (101 and 102), the capacitance (103) and the operational amplifier (110). The idle point of this amplifier is set by the dividing bridge made up of the resistances (80 and 82) filtered by the capacitance (82). The current passes through the resistance (104) and the unitary gain amplifier (106) to be injected via the resistance (107) into the oscillating circuit made up of the coil (108) and the capacitance (107). The oscillation level is taken between the resistance (108) and the capacitance (107) to be presented at the input of the analog digital converter of the microcontroller (79). The other elements of the assembly of FIG. 7 have the same function as those of FIG. 6. According to this principle, the pseudo-treasure is a tuned circuit (inductance capacitor) on the emission frequency of the detector, or any other absorbent device, for example a Thomson ring. In the presence of a pseudo-treasure, the voltage measured by the ND converter will decrease; the zone corresponding to the goal, the found treasure process is triggered by the microcontroller.

>> Embodiment According to the Third Detection Principle, Called Reverse

The pseudo-detectors given to the players comprising a stable oscillator that powers an infrared LED diode produce an infrared radiation modulated on a frequency specific to them.

Figure 8:
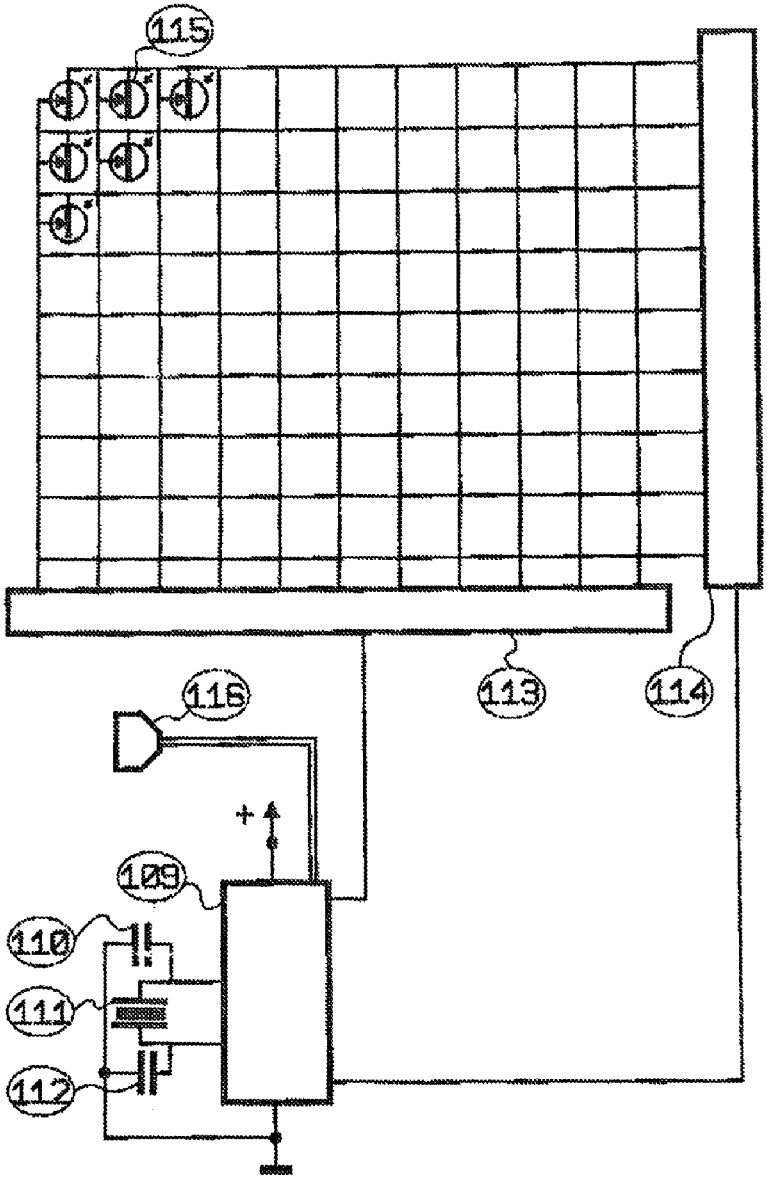
FIG. 8 shows a block diagram of the pseudo-treasure system according to the third detection principle.
Figure 9:
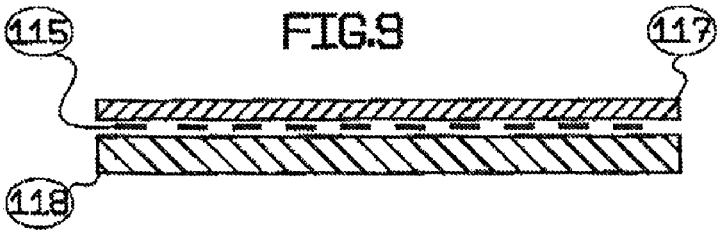
FIG. 9 shows a playing area carpet.

FIG. 9 shows that the infrared photo-detectors (115) are integrated into a carpet (118) serving as playing area. The photo-detectors are protected by an infrared-transparent but opaque plastic sheet (117) in the visible range so as to conceal the pseudo-treasures from public view. In reference to FIG. 8, a matrix (cabled in X Y) of sensors (115) is connected to a detection interface. This interface comprises two ports (113, 114) that receive from the sensors a digital signal whereof the frequency varies as a function of the pseudo-detector producing the signal. In each game, only several inputs of the ports are active, thereby determining several pseudo-treasures on the playing area. The microcontroller (109) is equipped with a precise clock made up of a quartz (111) and two capacitances (110 and 112); it converts, owing to that clock and software that performs a comparison with the frequency table stored in memory, the received player code frequency. This code as well as the pseudo-treasure number obtained by selecting inputs are communicated via a serial connection (116) to a game management computer that compares the code picked up with the player's goal table. This matrix-based principle is adapted to small indoor economical playing areas. One alternative can be produced by replacing the LED diodes and the photo-detectors with coils producing an electromagnetic field.

The system according to the invention is intended to be exploited in recreational locations (beaches, amusement parks, party or game rooms, etc.) or used as an advertising promotional tool on the sales sites. It may be the basis for a televised game, a website or a radio show.

The invention claimed is:

1. An interactive system configured to simulate a treasure hunt comprising:

a plurality of pseudo-treasures distributed over a playing area buried or located just above the ground visibility, and a detector located at the extremity of a support tube allocated to at least one player, the detector configured to scan the playing area and detect at least one pseudo-treasure of the plurality of pseudo-treasures, the plurality of pseudo-treasures each configured to transmit an encoded magnetic signal and an encoded magnetic field and the detector configured to sense the magnetic field of the plurality of pseudo-treasures, and to analyze said signal to indicate whether the plurality of pseudo-treasures are located within the allotted time, and at least one computer configured to allocate, to the at least one player, at least one specific pseudo-treasure to be located within a predetermined period, the at least one computer configured to generate, for the at least one player, at least one goal table randomly with the pseudo-treasures current or available to be located by a player, during each game match, each pseudo-treasure comprising identification means, and the detector being configured to identify the scanned pseudo-treasures in response to magnetically communicating with the scanned pseudo-treasures and indicate the pseudo-treasure(s) located in the allotted period, said system further comprising at least one of the following means:

means configured to dig a virtual hole in response to the at least one player physically moving the detector when a pseudo-treasure among the plurality of pseudo-treasures is located by the at least one player, and means configured to open an element containing a prize or winnings allocated to the a located pseudo-treasure when said pseudo-treasure(s) is located.

2. The system according to claim 1, wherein the computer comprises means configured to determine, in real-time, the timing schedule of the pseudo-treasures according to the players present in the playing area and the evolution of their game.

3. The system according to claim 1, wherein each of the pseudo-treasures and each of the detectors are, respectively, capacitive or ultrasound or infrared or high-frequency transmitters and receivers.

4. The system according to claim 1, further comprising means for determining the parameter coordinates of each of the pseudo-treasures and means for detecting the spatial coordinates of each of the detectors on the playing area.

5. The system according to claim 4, wherein each of the pseudo-treasures is passive and able to able to absorb a magnetic field emitted by each of the detectors.

6. The system according to claim 1, wherein each of the pseudo-treasures and each of the detectors are, respectively, magnetic, capacitive or infrared sensors and transmitted.

7. The system according to claim 1, further comprising a sound assistance device configured to at least broadcast messages to the player and/or to perform a sound and light animation varying according to the proximity of the detector of the player relative to the pseudo-treasure to be located.

8. The system according to claim 1, further comprising means configured to display, for the at least one player, a located pseudo-treasure.

9. The system according to claim 1, wherein the means configured to dig a virtual hole includes removing a plurality of physical elements stored in a first physical container.

10. The system of claim 9, wherein the plurality of physical elements covers a first identifier that identifies a respective pseudo-treasure, and wherein the means configured to dig a virtual hole further includes transferring the plurality of physical elements from the first physical container to a second container such that the identifier is exposed.

* * * * *